US005508158A

United States Patent [19]

Yamashita et al.

[11] Patent Number: 5,508,158

[45] Date of Patent: Apr. 16, 1996

[54] SILVER HALIDE LIGHT-SENSITIVE PHOTOGRAPHIC EMULSION, A SILVER HALIDE LIGHT-SENSITIVE PHOTOGRAPHIC MATERIAL AND A METHOD OF PROCESSING THEREOF

[75] Inventors: Kiyotoshi Yamashita; Shu Nishiwaki; Yasuo Honda, all of Hino, Japan

[73] Assignee: Konica Corporation, Japan

[21] Appl. No.: 207,353

[22] Filed: Mar. 7, 1994

[30] Foreign Application Priority Data

Mar. 10, 1993 [JP] Japan ..... 5-049441

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 5,057,409 | 10/1991 | Suga | 430/567 |
| 5,068,173 | 11/1991 | Takehara et al. | 430/567 |
| 5,176,992 | 1/1993 | Maskasky et al. | 430/567 |
| 5,217,858 | 6/1993 | Maskasky | 430/567 |
| 5,219,720 | 6/1993 | Black et al. | 430/567 |
| 5,310,644 | 5/1994 | Delton | 430/567 |

FOREIGN PATENT DOCUMENTS

| | | |
|---|---|---|
| 416881 | 3/1991 | European Pat. Off. . |
| 515894 | 12/1992 | European Pat. Off. . |

*Primary Examiner*—Janet C. Baxter

*Attorney, Agent, or Firm*—Jordan B. Bierman; Bierman and Muserlian

[57] ABSTRACT

A silver halide photographic light sensitive material comprising a support having thereon a silver halide emulsion layer containing silver halide grains, wherein the silver halide emulsion contains silver halide tabular grains having an aspect ratio of a diameter to a thickness of less than 8 and accounting for at least 70% of the total grain projection area of the emulsion; the tabular grains having a ratio (t/l) of the thickness (t) to the longest distance (l) between two or more parallel twin planes of the tabular grain of not less than 5; total surface of the tabular grain consisting of two parallel principal plane faces and side-faces, and all of the parallel principal plane faces and 90% or less of side-faces are a (111) face.

8 Claims, No Drawings

SILVER HALIDE LIGHT-SENSITIVE PHOTOGRAPHIC EMULSION, A SILVER HALIDE LIGHT-SENSITIVE PHOTOGRAPHIC MATERIAL AND A METHOD OF PROCESSING THEREOF

FIELD OF THE INVENTION

Present invention relates to a silver halide light-sensitive silver halide emulsion which comprises tabular silver halide grains; a silver halide light-sensitive photographic material in which said emulsion is used; a silver halide light-sensitive photographic material especially useful for medical use; and a method of processing the light-sensitive material.

To be more specific, the present invention relates to (i) a silver halide light-sensitive photographic emulsion having enhanced sensitivity with less fluctuation in the photographic properties with the lapse of time and especially excellent in pressure resistance characteristics, (ii) a silver halide light-sensitive photographic material comprising said silver halide light-sensitive photographic emulsion which is suitable for medical use, (iii) a silver halide light-sensitive photographic material suitable for medical use and (iv) a method of processing the photographic material.

BACKGROUND OF THE INVENTION

Increasing sensitivity is the most effective means to improve various photographic properties of the silver halide light-sensitive photographic emulsion. For example, high sensitive light-sensitive color photographic materials of recent years were realized by making the emulsion high sensitivity. About improvement of picture quality, it is widely known in the art that it is possible to improve graininess by using a silver halide emulsion containing silver halide grains of smaller grain size and enhanced sensitivity.

Moreover, in the field of x-ray photography, in order to maintain high sensitivity while achieving a high sharpness and effectively cutting off crossover light, development of a light-sensitive silver halide emulsion with increased sensitivity is indispensable. Accordingly, various research and development have been made, attempting to produce a silver halide light-sensitive emulsion having enhanced sensitivity.

Especially in recent years, a lot of techniques of attaining high sensitivity, by using of silver halide grain of tabular shape has been reported in the art. Those examples are described, for example, in Japanese Patent O.P.I. Publications No.58-111935(1983), No.58-111936(1983), No.58-111937(1983), No.58-113927(1983) and No.59-99433(1984), etc.

Since the surface area of the tabular silver halide grain is larger than that of a so-called regular shape silver halide grain, such as cubic or octahedral grains, so that it is possible to increase the adsorption amount of sensitizing dye on the surface of the grain, and, as a result, there is an advantage that elevation of light-sensitivity may easily be achieved.

Japanese Patent O.P.I. Publication No.63-92942(1988) discloses a technique, in which a core with a high silver iodide content is provided inside the tabular silver halide grain. Moreover, Japanese Patent O.P.I. Publication No.63-151618(1988) discloses a technique, in which a tabular silver halide grain having hexagonal shape is used. And in these references effect of enhancing sensitivity is shown.

Besides these, a technique concerning distributing silver halide composition inside the tabular silver halide grain is disclosed in Japanese Patent O.P.I. Publications No.63-106746(1988),No.1-183644(1989),No.1-279237(1989), etc.

Further, in connection with the crystal structure of the tabular silver halide grain, some techniques of the shape of the grain and a parallel twin plane are also disclosed. For example, Japanese Patent O.P.I. publication No.1-131541(1989) discloses a technique to improve sensitivity and graininess by using a round tabular grain.

Japanese Patent O.P.I. Publication No.63-163451(1988), discloses a technique to use a tabular silver halide crystal having a pair of parallel twin planes, of which ratio (t/1) of distance between twin planes (1) and thickness of the grain (t) is not less than 5. And improved effects in sensitivity and graininess are exhibited. Therein, a technique for enhancing sensitivity by uniforming the distance between the twin planes among the grains and a technique, whereby to improve sensitivity and graininess is disclosed.

International Patent Application No. WO91/18320 discloses a technique of using a tabular silver halide grain of which the distance between twin planes is less than 0.012 microns: In this reference, it is described that by this technique enhancement of sensitivity was realized.

European Patent Application No. EP515894A1 refers to a technique by which to attain enhanced sensitivity by using a tabular silver halide grain of which flatness defined in terms of (grain size)/(thickness) is not less than 25 and the proportion of (111) face in edge-side surface is made less than 75%.

On the other hand, attempts to improve defects of the tabular silver halide grain have also been made. For example, Japanese Patent O.P.I. publication No.3-142439 (1991) discloses a technique to improve preservability under high humidity by employing a silver halide emulsion containing a silver halide grain of which an aspect ratio is not less than 3 and making proportion of projection area of the tabular grains having (111) face and (100) face not less than 50%.

Moreover, tabular silver halide grain has a defect that its pressure resistance characteristics are not so good.

Herein, the pressure resistance characteristics denote two photographic phenomena,that is to say, (a) a phenomenon of so-called pressure fogging,in which when pressure is applied to a silver halide light-sensitive photographic material, an unexposed portion of the light-sensitive material comes to be developed or so-called pressure fog takes place, and (b) a phenomenon of so-called pressure desensitization in which sensitivity lowering at the time of exposure takes place.

These defects of the silver halide light-sensitive photographic material can be a serious fault and lowers its commercial value. In general, silver halide grain is sensitive to pressure and, its sensitivity against pressure increases sharply corresponding to the increase of light-sensitivity and thus, this phenomenon is remarkable in the silver halide light-sensitive photographic material in which tabular silver halide grain is used. The reason for this is considered as follows: that is to say, a larger amount of moment is applied to a tabular grain as compared with a spherical shape grain having the same volume, even if they have the same mechanical strength, and thus mechanical strength of the tabular grain as a whole becomes weaker than that of the spherical grain.

Besides the shape of the silver halide grain, pressure resistance characteristics of the silver halide crystal depend upon distribution of halide composition inside the silver halide grain and on the conditions of chemical sensitization.

In general, desensitization due to pressure is likely to cause when the degree of chemical sensitization is not enough, or, in the case of lacking in the chemical ripening. When the level of chemical sensitization is excess, desensitization due to pressure tends to decrease, however, in this case, pressure fogging is inclined to be greater. In general, when the level of chemical sensitization is excess, pressure desensitization decreases, however, in this case, pressure fogging tends to increase. Moreover, when the silver the halide grain has an internal high iodide content, there is a tendency that the pressure desensitization increases although pressure fogging is improved.

As a means to overcome deterioration of such pressure resistance characteristics, some means for improving pressure characteristics of silver halide emulsion are disclosed in, for example, Japanese Patent O.P.I. Publications No. 59-99433(1974), No. 63-30.1937(1988), No. 63-149641(1988), No. 63-106746(1988), No. 63-151618(1988), No. 63-220238(1988), Japanese Patent O.P.I. publications No. 1-131541(1989),No. 2-193138(1990), No. 3-172836(1992) and No. 3-231739(1992). However, these means have not achieved sufficient effect of improvement.

SUMMARY OF THE INVENTION

The first object of present invention is to provide a light-sensitive silver halide emulsion which contains tabular silver halide crystals with improved storage stability, enhanced sensitivity and, especially excellent pressure resistance characteristic.

The second object of present invention is to provide a silver halide light-sensitive photographic material with enhanced sensitivity, improved storage stability and, especially excellent pressure resistance characteristics.

The third object of the present invention is to provide a silver halide light-sensitive photographic material specially suitable for medical use, having improved sensitivity, storage stability and, especially, pressure resistance characteristics.

Moreover, the fourth object of the present invention is to provide a method of processing a silver halide light-sensitive photographic material which is especially suitable for medical use, with improved sensitivity, storage stability and, especially pressure resistance characteristics.

Present inventors have carried out investigation on the pressure resistance characteristics of the tabular grains in view of the relation between crystal surface and the twin plane contained therein. And, as a result, the inventors came to accomplish the present invention.

That is to say, the first object of the present invention can be achieved by (i) a silver halide light-sensitive photographic emulsion comprising tabular silver halide grains, wherein said tabular silver halide grain is characterized in that
  (a) at least 70% of projection area of the total silver halide grains contained in the emulsion is a tabular silver halide grain, of which aspect ratio expressed in terms of (grain size)/(thickness) ratio is less than 8.0;
  (b) the tabular silver halide crystal has at least two twin planes which are in parallel with each other;
  (c) the average ratio (t/l) of the longest distance (l) between parallel twin planes to thickness (t) of said, tabular grain is not less than 5; and
  (d) all of principal plane surfaces parallel with each other and not more than 90% of surfaces existing in the edge-side portion of the tabular crystal consist of (111) face;

The second object of the present invention is attained by (ii) a silver halide light-sensitive photographic material which comprises a silver halide light-sensitive emulsion of (i);

The third object of the present invention is achieved by (iii) a silver halide light-sensitive photographic material for medical use which comprises a silver halide light-sensitive emulsion of (i); and the fourth object of the present invention is achieved by (iv) a method of processing a silver halide light-sensitive photographic material of (iii), wherein said method comprises a step of processing with a solution not containing a hardener and the total processing of the silver halide photographic light-sensitive material is carried out within a time of 15 to 90 seconds.

DETAILED DESCRIPTION OF THE INVENTION

The silver halide of the present invention may use any one conventionally known and used in usual silver halide emulsions, including, for example, silver bromide, silver iodobromidede, silver iodochloride, silver chlorobromide, silver bromoiodide, and silver chloride. Among them silver bromide, silver iodobromide, and silver iodobromochloride are preferable.

Silver halide grains contained in the light-sensitive silver halide emulsion of the present invention are tabular silver halide grains. Herein, the term tabular silver halide grain denotes grain which has two parallel principal plane surfaces facing to each other, in which average ratio of grain diameter to thickness thereof, which is hereinafter referred to as "aspect ratio", is not less than 1.3. The grain diameter herein denotes the average projection diameter of the grain when a projected area of a silver halide grain is converted into a circle having the same projection area.

Moreover, "thickness of the grain" denotes the distance between the two principal plane surfaces of the tabular grain which are parallel to each other.

Tabular silver halide grains contained in light-sensitive silver halide emulsion of the present invention account for at least 70% of the projection area of the total silver halide grains contained in the emulsion, having an aspect ratio of less than 8, preferably, from not less than 2.0 to less than 8.0, more preferably not less than 3.0 to less than 8.0.

This is because when the aspect ratio is too large, and when pressure is applied to a silver halide light-sensitive material, moment which is applied to the silver halide grains becomes large, which leads to deterioration in the pressure resistance characteristics such as occurrence of desensitization or fogging due to pressure in the silver halide light-sensitive photographic material.

When, on the other hand, the aspect ratio is too small, the surface area of the grain decreases and, desired sensitivity may not be obtained.

The tabular silver halide grains of the present invention account for at least 70% of the projection area of the total silver halide grains contained in the silver halide emulsion, having flatness expressed in terms of (grain size) / (thickness)$^2$ of not less than 20, preferably, from not less than 20 to less than 80.

This is because when this is less than 20 or not less than 80, the effect of the present invention is either small or not obtainable due to relation between moment applied to the tabular silver halide grains and the strength of the grain itself.

The tabular silver halide grain of the present invention is classified as a kind of twin crystal according to crystallographic classification. As to morphological classification of the twin crystal is described in Klein and Moisar, "Photographische Korrespondenz", on page 99, Volume No.99 and on page 57, Volume No.100.

The tabular silver halide crystal of the present invention has at least two twin planes which are parallel to a principal plane surface. The twin plane may be observed by the use of a transmission-type electron microscope.

The method is explained as follows: First of all, the light-sensitive silver halide emulsion is coated so that the principal plane face of the tabular silver halide grains may be oriented on the support almost in parallel with the support and resultingly, a sample is prepared.

Then this sample is cut with a diamond cutter to obtain a micro thin cut of 0.1 μm thick. This cut is observed with a transmission-type electron microscope to confirm existence of the twin planes.

The distance between twin planes (l) in the present invention denotes the distance between two twin planes in the case where there are two twin planes in the grain. In the case where there are three or more twin planes in the grain, the longest distance of the distances between each two twin planes adjacent to each other is defined to be the distance.

In the present invention, the ratio of the thickness of the crystal (t) to the distance between twin planes (l) can be obtained as follows:

Through observation by the use of transmission-type electron microscope, approximately 100 tabular silver halide grains, which show cross-section faces cut almost perpendicular to the main face thereof are taken for measurement, and, (t/l) of each grain is measured and then obtain the average ratio from calculating additive average thereof.

In the present invention, the average ratio (t/l) is not less than 5. Preferably, the ratio is not less than 7. Moreover, it is further preferable that the silver halide grains having a ratio (t/l) of not less than 5 account for not less than 50% number, preferably 70% or more, more preferably 90% or more.

In the present invention, all of parallel principal plane surfaces and not more than 90% of crystal faces existing in the side-face portion of the grain consist of (111) crystal face. Usually the principal plane surface of a tabular silver halide crystal consists of (111) face. It is well known in the art that crystal faces other than the principal plane surface, namely, crystal faces in the side-face portion consist of (111) face.

Herein, the term "not more than 90% of crystal faces in the side-face portion consist of (111) face" means that there exist crystal faces other than (111) face of not less than 10% in the side-face portion.

In the present invention, preferable crystal face other than (111) face is (100) face.

It is preferable that the (111) face existing in the side-face portion is not more than 80%. Namely, it is especially advantageous that the crystal faces other than (111) face exist in the side-face portion in a proportion of not less than 20%. And it preferably be (100) face.

In the present invention, as to the method of measuring crystal faces in the side-face portion of the tabular silver halide crystal, for example, one which is disclosed on pages 165 through 171 in "The Journal of Imaging Science", vol. 29, No. 5 September 1985, by Tani, et al. can be referred.

In the present invention, it is important that the silver halide grain contained in the silver halide emulsion satisfy two requirements at the same time. That is to say, the average of (t/l) of the tabular silver halide crystal is not less than 5 and, not more than 90% of crystal faces in the side-face portion and all of the parallel principal plane surface consist of (111) crystal faces.

As for the grains in which (111) faces occupy more than 90% of the side-face portion, even if the average (t/l) is 5 or more, the improvement in the pressure resistance characteristics may not be achieved. On the other hand, silver halide grains having average (t/l) of less than 5 do not achieve improvements in the pressure resistance characteristics.

This is considered to be because when these conditions are satisfied, the optimum condition for forming a chemical sensitization speck appropriate for pressure resistance characteristics is attained.

Suitable size of the tabular silver halide grain used in the present invention is preferably 0.4 to 3.0 μm and, more preferably, 0.4 to 2.0 μm.

The average thickness of the tabular silver halide grains used in the present invention is preferably 0.05 to 1.0 μm, more preferably, 0.05 to 0.40 μm and, further more preferably, 0.05 to 0.20 μm.

The grain size and the thickness can be optimized so that the tabular silver halide grain may possess excellent sensitivity, storage stability, and pressure resistance characteristics. The optimum grain size and thickness vary depending upon other factors which have an influence on sensitivity, storage stability and pressure resistance. Such factors include, for example, thickness of hydrophilic, colloidal layer, hardening degree, chemical ripening conditions, light-sensitivity of the photographic material, coated amount of silver, etc.

The silver halide emulsion of the present invention is preferably so-called a "monodisperse emulsion" with narrow grain size distribution.

More specifically, the distribution width, expressed in terms of (standard deviation of grain size)/(average of grain size)×100 =Grain size distribution width(%), is preferably not more than 25%, more preferably not more than 20%, and further more preferably not more than 15%.

Also, the silver halide grains contained in the silver halide emulsion of the present invention preferably has narrow thickness distribution. More specifically, the thickness distribution width, expressed in terms of (standard deviation of thickness distribution)/(average thickness)×100 =thickness distribution width(%), is preferably not more than 25%, more preferably not more than 20%, and further more preferably, not more than 15%.

In the present invention, the tabular silver halide grain preferably is a hexagonal shape. The hexagonal tabular grain of the present invention, which may be hereinafter referred to as "hexagonal tabular grain", means a grain of which the shape of the main (111) face has a hexagonal shape and the maximum edge ratio of which is between 1.0 and 2.0.

Herein, the term "maximum edge ratio" is defined to be a ratio of the length of a edge having the maximum length to one having the minimum length in the hexagonal tabular silver halide grain.

In the present invention, the hexagonal tabular silver halide grain may have roundish corners, if it's maximum vicinity ratio falls within a range between 1.0 and 2.0.

Length of a side, when the corner bears roundness, is measured by extending the straight line portion of a side of the hexagonal tabular grain and measuring distances between two intersections of two pairs of extended lines which are adjacent to each other.

In the present invention, all the corners of the tabular grain may be rounded. In this case, the tabular grain substantially has a spherical shape.

In the present invention, it is preferable that not less than one half of each sides of the hexagonal tabular grain consist substantially of straight lines. The maximum vicinity ratio is preferably 1.0 to 1.5.

The tabular silver halide grain used in the present invention is preferably so-called a core/shell-type grain.

Herein the term core/shell type grain means a silver halide grain which consists of a inner portion and a outer layer such as a double-structure grain having halide composition different from one another in the inside and the surface of the grain; a silver halide grain having a multilayer structure as disclosed in Japanese Patent O.P.I. Publication No. 61-245151(1986); etc.

The core/shell type silver halide grain preferably used in the present invention is one having an outermost layer of which silver iodide content is less than 5 mol % and, more preferably, less than 3 mol %.

The light-sensitive silver halide emulsion of the invention can be prepared by placing an aqueous solution containing a protective colloid and, if necessary, a seed emulsion in a reaction vessel, and adding thereto silver ions, halogen ions and, if necessary, a fine grain emulsion and a silver halide solvent to form grains through the steps of nucleus formation, Ostwald's ripening and grain growth.

In manufacturing the light-sensitive silver halide emulsion of the invention, there can be employed various methods which are well known in the art. That is, the single jet method, the double jet method and the triple jet method can be arbitrarily combined. Further, a method, which controls the pH and pAg of a reaction liquor where silver halide is formed correspondingly to the growth rate of the silver halide, can also be combined.

Moreover, the silver halide composition of grains may be varied by applying the conversion method anytime during silver halide formation. Or, halide ions and silver ions may be added in the form of silver halide fine grains.

In the manufacture of the silver halide light-sensitive emulsion of the present invention, it is necessary to control formation and growth of the principal plane face, side-face and the twin plane of the tabular grain.

The twin plane can be controlled, no matter whether a seed emulsion is used or not, by appropriately selecting factors, which exert influences upon the supersaturation state at the time of nucleus formation, such as gelatin concentration, temperature, iodine ion concentration, pBr, ion supplying rate, stirring rate, kind of gelatin, as well as by selecting a proper combination of amounts and kinds of adsorptive additives. Further, this control can also be made by properly selecting the conditions of Ostwald's ripening and grain growth, such as gelatin concentration, temperature, iodine ion concentration, pBr, ion supplying rate, stirring rate, kind of gelatin, kind and amount of silver halide solvent. Details of supersaturation factors can be seen, for example, in the specifications of Japanese Pat. O.P.I. Pub. Nos. 92942/1988 and 213637/1984.

The principal plane face can be controlled by properly selecting factors, such as gelatin concentration, temperature, iodine ion concentration, pBr, ion supplying rate, stirring rate, kind of gelatin, kind and amount of silver halide solvent, throughout the whole process including nucleus formation, Ostwald's ripening and grain growth.

Moreover in the present invention, in order to make (111) faces existing in the side-face portion of the tabular silver halide crystal a proportion of not more than 90%, and, preferably, not more than 80%, various methods which are well-known in the art may be employed either individually or in combination. For example, description in Japanese Patent O.P.I. publication No.2-298935(1990) may be referred to.

To be more specific, it is preferable to control, pAg during the growth of silver halide grains, a concentration of the silver halide solvent, pH during growth of the silver halide grains, etc.. Moreover, the tabular silver halide crystal can be formed in the presence of a compound which is selectively adsorptive to the crystal face. As such compound, photographic sensitizing dye or nitrogen-containing, heterocyclic compound is useful.

In the manufacture of light-sensitive silver halide emulsion of the invention, there can be used a seed emulsion, which is prepared by a method well known in the art such as the single jet method or the controlled double jet method. The halide composition of the seed emulsion may be arbitrarily selected from silver bromide, silver iodide, silver chloride, silver iodobromide, silver chlorobromide, silver chloroiodide and silver chloroiodobromide. Among them, preferred are silver bromide and silver iodobromide.

When a seed emulsion is used, such a seed emulsion preferably comprises grains having twin planes. The shape of seed grains is not particularly limited. In manufacturing the light-sensitive silver halide emulsion of the invention using a seed emulsion, silver halide nuclei are formed in the step of manufacturing the seed emulsion; therefore, the twin plane can be controlled by selecting an appropriate combination of factors exerting influences upon the supersaturation state during nucleus formation, such as gelatin concentration, temperature, iodine ion concentration, pBr, ion supplying rate, stirring rate, kind of gelatin, etc.

In the manufacture of the tabular silver halide grains, silver halide solvents, such as ammonia, thioether and thiourea, may be used if necessary.

The silver halide grains used in the light-sensitive silver halide emulsion of the invention may contain a metallic ion at their inner portions and/or surfaces; that is, metallic ions may be incorporated in these grains by adding at least one metallic salt or metallic complex salt selected from cadmium salts, zinc salts, lead salts, thallium salts, iridium salts (including complex salts), rhodium salts (including complex salts) and iron salts (including complex salts), in the process of forming grains and/or the process of growing grains. Or, there may be formed reduction-sensitized specks at inner portions and/or surfaces of grains by placing these grains in a reducing environment.

In carrying out the invention, gelatins are favorably used as the dispersion medium for a protective colloid of silver halide grains. Suitable gelatins include alkali-processed gelatins, acid-processed gelatins, low molecular weight gelatins (molecular weight: 20,000 to 100,000) and phthalated gelatins. Other types of hydrophilic colloids can also be used, examples of which include those described in Research Disclosure (hereinafter referred to as RD), Vol.176, No.17643 (Dec., 1978).

The light-sensitive silver halide emulsion of the invention may be subjected, after grains have grown, to desalting for the removal of soluble salts, or it may contain soluble salts left unremoved. When such salts are removed, desalting can be performed according to the method described in RD, Vol.176, No.17643 (Dec., 1978).

The light-sensitive silver halide photographic emulsion can be chemically sensitized.

There is no special limitation as to the conditions under which chemical ripening is carried out. In other words, upon carrying out the chemical ripening, conditions such as pH, pAg, temperature, time, etc. may optionally be selected with reference to methods known and used in the field of the art. In order to perform chemical sensitization, sulfur sensitization with the use of a sulfur-containing compound or active gelatin capable of reacting silver irons, selenium sensitization with the use of a selenium compound, tellurium sensitization with the use of a tellurium compound, reduction sensitization with the use of a reducing material and noble metal sensitization with the use of gold or a noble metal are employed singly or in combination. Among known chemical sensitization processes, selenium sensitization process, tellurium sensitization process and reduction sensitization process, etc. may preferably be used in the present invention.

In the case of selenium sensitization, a variety of selenium compounds may be used as a sensitizer. For instance, this is described in U.S. Pat. No. 1574944 issues, 1602592 issues, 1623499 issues, Japanese Patent O.P.I. Publication No. 60-150046, Japanese Patent O.P.I. publication No.4-25832, No. 4-109240, and 4-147250, etc. Especially useful selenium sensitizers among these include colloidal selenium metals; iso-selenocyanates such as allylselenocyanate, etc.; selenoureas such as N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea, etc.; selenoketones such as selenoacetone, selenoacetophenone, etc.; selenoamides such as selenoacetamide, N,N-dimethylselenobenzamide, etc.; selenocarboxylicacids and seleno esters such as 2-seleno propionicacid, methyl-3-selenobutylate, etc.; selenophospates such as tri-p-triselenophosphate, etc.; selenides such as diethylselenide, diethyldiselenide, etc,; selenium ketones. Among these selenoureas, selenoamides and selenoketones are preferable. The specific example of the utilization technique of these selenium sensitizer is disclosed in a following patent specifications: U.S. Pat. Nos. 1,574,944, 1,602,592, 1,623,499, 3,297,446, 3,297,447, 3,320,069, 3,408,196, 3,408,197, 3,442,653, 3,420,670, 3,591,385; French patents No. 2,693,038, No.2, 093,209; Japanese Patent Publications No.52-34491(1977), No.52-34492(1977), No.53-296(1978), No.57-22090(1982); Japanese Patent O.P.I. Publications No.59-192241(1894), No.59-185330, No.59-181337(1984), No.59-187338(1984), No.59-192241 (1984), No.60-150046(1985), No.60-151637(1985) No.61-246738(1986), No.3-4221(1991), No.3-24537(1991), No.3-111838(1991), No,3-116132(1991), No.3-148648(1991), No.3-237450(2991), No.4-16838(1992), No.4-25832(1992), No.4-32831(1992), No,4-96059(199), No.4-109240(1992), No.4-140738(1992), No.4-140739(1992), No.4-147250(1992),No,4-149437(1992), No.4-184331(1992), No.4-190225(1992),No,4-191729(1992), No.4-195035(1992),British Patents No.255,846, No.861,984. Similar reference can be made to on pages 158 through 169, Vol. 31(1983) of "The Journal of Photographic Science", written by h. E. Spencer.

Although the amount of the use of selenium sensitizer varies depending on selenium compound, silver halide grain, and the chemical ripening conditions, it is within a range of $10^{-8}$ and $10^{-4}$ mols per mol of silver halide. In accordance with the nature of the selenium compound, the compound may be added by the procedure of dissolving in water, organic solvent such as methanol or ethanol, or mixture thereof; by the procedure of mixing with a gelatin solution; or by the procedure of dispersing in the form of the emulsion mixed with organic solvent-soluble polymer as disclosed in Japanese Patent O.P.I. Publication 4-140739(1992). Selenium sensitization is carried out preferably at a temperature of 40 to 90° C., more preferably 45 to 80° C. pH is preferable within the range of 4 and 9 and pAg, the range of 6 and 9.5.

Tellurium sensitizers and the sensitization method are disclosed in, for example, U.S. Pat. Nos. 1,623,499, 3,320,069, 3,772,031, 3,531,289, 3,655,394; British Patents No. 235,211 and No.1,121,496 and No. 1,295,462 and No. 1,396,696; Canadian Patent No. 800,958; Japanese Patent O.P.I. Publications No.4-204640(1992). Telluroureas and telluroamides are given as useful examples of tellurium sensitizers.

The method of using the tellurium sensitizers is similar to the case of selenium sensitizers.

In the present invention, it is also preferable to provide a reduction sensitization speck on the surface of the grain or inside thereof by exposing the silver halide emulsion to the reductive atmosphere and thereby parform reduction sensitization.

Typical preferable examples of reducing agents are, for example, thiourea dioxide, ascorbic acid and a derivative thereof, hydrazine, polyamines such as dithylene triamine, dimethylamine-boranes and sulfites. Addition amount of the reducing agent may be varied depending upon various conditions such as kind of the reducing agent to be used; size, halide composition or crystal habit of the silver halide grain; reaction conditions such as temperature, pH, pAg, etc. In the case of thiourea dioxide, for example, it is preferable to add in an amount of 0.01 to 2 mg per mol of silver halide. In the case of ascorbic acid, it is preferable within a range of 50 mg and 2 grams.

The conditions for reduction are preferably 40°–70° C. as for temperature, 10 to 200 minutes as for time, 5 to 11 as for pH, 1 to 11 as for pAg.

Water-soluble silver salt is preferably silver nitrate. By the addition of the aqueous silver salt, so-called silver ripening, which is a kind of reduction sensitization, is conducted. Suitable pAg during the silver ripening is between 1 and 6 and, more preferably, between 2 and 4.

Preferable conditions concerning temperature, pH, and time, etc., are within those given in the case of the reduction sensitization.

As for the stabilizing agent of the silver halide photographic emulsion containing silver halide grains reduction-sensitized, those which are well known in the art can be used. When an antioxidant as disclosed in Japanese Patent O.P.I. Publication 57-82831(1982) and/or two or more of thiosulfuric acid compounds disclosed in V. S. Gahler, Zeitschrift fur wissenschaftliche Photographic Bd. 63,133(1969) and Japanese Patent O.P.I. Publication No. 54-1019(1979) are used in combination, an excellent results can be obtained. These compounds may be added during any step in the emulsion manufacturing process, i.e., from the stage of crystal growth to immediately before coating.

In the present invention, the reduction sensitization, the selenium sensitization and the tellurium sensitization mentioned above may be employed either individually or two or more kinds in combination. It is preferable that one of these sensitization methods is used together with other kind of sensitizations, for example, sensitization with the use of a noble metal compound.

The silver halide photographic light-sensitive material of the invention is a silver halide photographic light-sensitive material containing the foregoing light-sensitive silver halide emulsion of the invention and includes, for example, black-and-white silver halide photographic light-sensitive materials (e.g., light-sensitive materials for radiography, light-sensitive materials for printing, negative light-sensitive materials for popular use), color photographic light-sensitive materials (e.g., color negative light-sensitive materials, color reversal light-sensitive materials, light-sensitive materials for color printing), light-sensitive materials for diffusion transfer, and heat-developable light-sensitive materials. Among these, preferable one is a black and white photographic material; more preferably, a photographic material for radiography.

Moreover, it is one of the characteristic features of the present invention that the silver halide light-sensitive photographic material for radiography of the present invention is processed by a process comprising a step of processing a photographic material in a bath not containing a hardener, wherein the total processing is carried out within a period between 15 and 90 seconds.

In making the silver halide photographic light-sensitive material which uses the light-sensitive silver halide emulsion of the invention, the light-sensitive silver halide emulsion is subjected to spectral sensitization and, further, various additives are added thereto according to specific requirements. Suitable additives and other materials include, for example, those shown in RD Nos. 17643 (Dec.,1978), 18716 (Nov.,1978) and 308119 (Dec.,1989). Locations where there are shown are as follows:

| Additives | RD-17643 Page Class. | RD-18716 Page Class. | RD-308119 Page Class. |
|---|---|---|---|
| Chemical sensitizers | 23 III | 648 upper right | 996 III |
| Sensitizing dyes | 23 IV | 648–649 | 996–8 IV |
| Desensitizing dyes | 23 IV | | 998 IV |
| Dyes | 25–26 VIII | 649–650 | 1003 VIII |
| Development accelerators | 24 XXI | 649 upper right | |
| Antifoggants stabilizers | 24 IV | 649 upper right | 1006–7 VI |
| Whitening agents | 24 V | | 998 V |
| Hardeners | 26 X | 651 left | 1004–5 X |
| Surfactants | 26–7 XI | 650 right | 1005–6 XI |
| Antistatic agents | 27 XII | 650 right | 1006–7 XIII |
| Plasticizers | 27 XII | 650 right | 1006 XII |
| Slipping agents | 27 XII | | |
| Matting agents | 28 XVI | 650 right | 1008–9 XVI |
| Binders | 26 XXII | | 1003–4 IX |
| Supports | 28 XVII | | 1009 XVII |

EXAMPLES

The present invention is further explained with reference to the following examples but the scope of the present invention is not limited by these.

EXAMPLE 1

Preparation of Seed Emulsion 1: Seed Emulsion 1 was prepared as follows.

| | | |
|---|---|---|
| A1: | Ossein gelatin | 100 g |
| | Potassium bromide | 2.05 g |
| | Water | 11.5 l |
| B1: | Ossein gelatin | 55 g |
| | Potassium bromide | 65 g |
| | Potassium iodide | 1.8 g |
| | 0.2N-sulfuric acid | 38.5 ml |
| | Water | 2.6 l |
| C1: | Ossein gelatin | 75 g |
| | Potassium bromide | 950 g |
| | Potassium iodide | 27 g |
| | Water | 3.0 l |
| D1: | Silver nitrate | 95 g |
| | Water | 2.7 l |
| E1: | Silver nitrate | 1410 g |
| | Water | 3.2 l |

Into Solution Al of which temperature was maintained at 60° C. in a reaction vessel, Solution B1 and Solution D1 were added over a period of 30 minutes with controlled double-jet mixing method. Then Solution C1 and Solution E1 were added to the mixture for 105 minutes with controlled double-jet mixing method. During mixing, agitation of the solution was made at 500 r.p.m.

The addition was made at a flow rate whereby no nucleation and no widening in grain size distribution due to Ostwald ripening take place. When silver ion solution and halide ion solution are added, pAg of the solution was adjusted using potassium bromide solution within a range of 8.3±0.05 and pH was adjusted using sulfuric acid at a range of 2.0±0.1.

After completion of addition, pH of the solution was adjusted at 6.0. and then desalting was carried out according to the method disclosed in Japanese Patent publication 35-16086(1960), to remove unnecessary salts.

As a result of observation with an electron microscope, a this seed emulsion was a monodispersed emulsion having an average grain size of 0.27 μm and size distribution width of 17%, containing tetradecahedral grains. Preparation of emulsion Em-1

A silver halide light-sensitive emulsion containing monodispersed silver halide core/shell type grains was prepared using Seed Emulsion 1 and seven kinds of solutions of which compositions are given below;

| | | |
|---|---|---|
| A2: | Ossein gelatin | 10 g |
| | Ammoniacal water (28%): | 28 ml |
| | Glacial acetic acid | 3 ml |
| | Seed emulsion 1 | 0.119-mol equivalent |
| | Add water to make the total volume | 600 ml |
| B2: | Ossein gelatin | 0.8 g |
| | Potassium bromide | 5 g |
| | Potassium iodide | 3 g |
| | Add water to make the total volume | 110 ml |
| C2: | Ossein gelatin | 2.0 g |
| | Potassium bromide | 90 g |
| | Add water to make the total volume | 240 ml |
| D2: | Silver nitrate | 9.9 g |
| | Ammoniacal water (28%) | 7.0 ml |
| | Add water to make the total volume | 110 ml |
| E2: | Silver nitrate | 130 g |
| | Ammoniacal water (28%) | 100 ml |
| | Add water to make the total volume | 240 ml |
| F2: | Potassium bromide | 94 g |
| | Water | 165 g |
| G2: | Silver nitrate | 9.9 g |
| | Ammoniacal water (28%) | 7.0 ml |
| | Add water to make the total volume | 110 ml |

The solution A2 was kept at 40° C. and agitated using an agitator at 800 r.p.m. pH of solution A2 was adjusted at 9.90 using acetic acid and Seed emulsion 1 was dispared therein. Then, solution G2 was added therein for seven minutes at a constant rate and afterwards pAg was adjusted at 7.3. Solutions B2 and D2 were further added simultaneously over a period of 20 minutes, while pAg of the mixture was maintained at 7.3.

After adjusting pH and pAg of the mixture to 8.83 and 9.0, respectively, using potassium bromide and the acetic acid over 10 minutes, solutions C2 and E2 were added simultaneously over a period of 30 minutes.

At this time, ratio of flowing quantity at the initiation of addition and at the completion thereof was 1:10 and the flowing rate was increased with time. Moreover, pH has was lowered made from 8.83 to 8.00 in proportion to the flowing quantity. Solution F2 was further added at a constant rate over a period of 8 minutes when two thirds of solutions C2 and E2 were added. At this time, pAg rose from 9.0 to 11.0 and pH was adjusted with acetic acid at 6.0.

After completion of the addition, in order to remove excess and unnecessary salts from the emulsion, desalting process was carried out by using an aqueous solution of Demol (a product of Kao Atlas Co. Ltd.) and magnesium sulfate, to obtain a silver halide emulsion containing silver halide grains, of which pAg, pH at 40° C. and the average silver iodide content was 8.5, 5.85 and 2 mol %, respectively.

As a result of observation with an electron microscope, thus obtained emulsion monodispersed core/shell type emulsion comprising rounded tetradecahedral grains having an average grain size of 0.55 μm and size distribution width of 14%.

Preparation of Seed Emulsion 2

Seed emulsion 2 of was prepared as follows.

| | | |
|---|---|---|
| A3: | Ossein gelatin | 24.2 g |
| | Water | 9657 ml |
| | Polypropyleneoxy-polyethyleneoxy-di-succinate sodium salt (10% ethanol aqueous solution) | 6.78 ml |
| | Potassium bromide | 10.8 g |
| | 10% nitric acid | 114 ml |
| B3: | 2.5N silver nitrate aqueous solution | 2825 ml |
| C3: | Potassium bromide | 824 g |
| | Potassium iodide | 23.5 g |
| | Water to make | 2825 ml |
| D3: | 2.5N Potassium bromide aqueous solution for controlling Ag electrode potential | |

Each 464.3 ml of solution B3 and solution C3 was added into solution A3 over a period of two minutes by the double-jet method using an agitator disclosed in Japanese Patent publications No. 58-58288(1983) and No. 58-58289(1983) so that nucleation was completed. The temperature of solutions A3 was raised to 60° C. spending 60 minutes after the addition of solution B3 solution C3 is stopped and pH was adjusted with 3%KOH to 5.0. Next, solution B3, and solution C3 were added again individually by the double-jet method for 42 minutes at the flowing rate of 55.4 ml/min. Silver electrode potential was controlled to be within a range of 8 and 16 mV by use of solution D3 during the period when a temperature was raised from 35 to 60° C. and solutions B3 and C3 were simultaneously added. (Using saturated silver-silver chloride electrode as a reference electrode, the silver electrode potential was measured with the silver ion selection electrode.)

Resulting emulsion was adjusted to pH of 6 by 3%KOH after completing addition and desalted. As a result of observation with electromicroscope, this seed emulsion was confirmed to contain hexagonal tabular grain, which exhibit maximum edge ratio of 1.0 to 2.0 and have an average thickness of 0.6 μ0.06 and, an average grain size (circle equivalent diameter) of 0.59 μm, accounting for not less than 90% of total projection areas of silver halide grains.

Preparation of emulsion Em-2

Tabular emulsion Em-2 of the invention was prepared by using Seed Emulsion 2 and three kinds of solutions of which compositions are given below:

| | | |
|---|---|---|
| A4: | Ossein gelatin | 5.26 g |
| | 10% ethanol aqueous solution of Sodium salt of polypropyleneoxy-polyethyleneoxy-di-succinate | 1.4 ml |
| | Seed Emulsion 2 | 0.094-mol (eq.) |
| | Water to make | 569 ml |
| B4: | Ossein gelatin | 15.5 g |
| | Potassium bromide | 114 g |
| | Potassium iodide | 3.19 g |
| | Water to make | 658 ml |
| C4: | Silver nitrate | 166 g |
| | Water to make | 889 ml |

Solution B4 and Solution C4 were added to Solution A4, while stirring vigorously at 60° C., with double-jet mixing method over a period of 107 minutes.

During the addition, pH and pAg of the mixture were maintained at 5.8 and 8.7, respectively. The addition speed of Solution B4 and Solution C4 solution was linearly increased so that addition speed at the time of completion was 6.4 time as much as that at the time of initiation.

After completion of the addition, desalting was carried out using an aqueous solutions of Demol (product of Kao Atlas Co. Ltd.) and magnesium sulfate to remove excess salts remained in the emulsion. Thus prepared emulsion was a silver iodobromide emulsion having pAg of 8.5 and, pH of 5.85 at 40° C. and the average silver iodide content of 2.0 mol %, respectively.

Through observation of the silver halide emulsion using an electron microscope, it was proved that 82% of the total projection area of the grains contained in the emulsion was tabular grains of which average grain size, distribution width and the average aspect ratio are 9.8 μm, 15% and 4.5, respectively.

Moreover, the average of ratio (t/l) of the logest distance between twin planes (l) and tabular thickness of the grain (t) was 11. It was found that all principal plane faces of the grain consisted of (111) face and the ratio of (111) face and (100) face in the side-faces, was 78:22.

Preparation of emulsion Em-3

An inventive silver halide emulsion containing tabular silver halide grain which had the core/the shell structure was prepared by using four kinds of solution as shown below.

| | | |
|---|---|---|
| A5: | Ossein gelatin | 11.7 g |
| | Disodium salt of polypropyleneoxy-polyethyleneoxy di-succinate (aqueous solution containing 10% ethanol) | 1.4 ml |
| | Seed emulsion 2 | 0.10-mol equivalent |
| | Water to make | 550 ml |
| B5: | Ossein gelatin | 5.9 g |
| | Potassium bromide | 4.6 g |
| | Potassium iodide | 3.0 g |
| | Water to make | 145 ml |
| C5: | Silver nitrate | 10.1 g |
| | Water to make | 145 ml |
| D5: | Ossein gelatin | 6.1 g |
| | Potassium bromide | 94 g |
| | Water to make | 304 ml |
| E5: | Silver nitrate | 137 g |
| | Water to make | 304 ml |

Solution B5 and Solution C5 were added to Solution A5 using double-jet mixing method for 48 minutes, under vigorous agitation at 70° C. During the addition, pH and pAg of the mixture was maintained at 5.8 and 8.7, respectively.

After completion of the addition, desalting was carried out to obtain a silver halide emulsion of which pH and pAg at 40° C. and the average silver iodide content are 5.85, 8.5 and 2.0%, respectively.

Through observation with an electron microscope, it was found that 81% of the total protection area of grains contained in the emulsion was tabular silver halide grains of which average grain size, size distribution width and the average aspect ratio are 0.96 μm, 18% and 4.5, respectively. The average of ratio (t/l) of distance between twin planes (l) and tabular thickness of the grain (t) was 10. The crystal face consists of (111) face and (100) face. All the principal plane faces consisted of (111) face and the ratio of (111) face and (100) face in the side-face portion of the grain was 86:14.

Preparation of emulsion Em-4

Emulsion Em-4 was prepared in the same manner as Em-2 except that pAg at the time of addition was changed from 8.7 to 8.9.

Preparation of Em-5

Emulsion Em-4 was prepared in the same manner as Em-2 except that pAg at the time of addition was changed from 8.7 to 8.9.

Preparation of emulsion Em-5

Em-5 was prepared in the same manner as Em-2 except that the amount of potassium bromide in Solution A3 in Seed Emulsion-2 of emulsion Em-2 was changed to 5.4 g.

Preparation of emulsions Em-7 through Em-9

Emulsions Em-7 through Em-9 were prepared in the same manner as Em-2 except that the amount of potassium bromide in Solution A3 in Seed Emulsion-2, period of addition of Solution B3 and Solution C3, pAg during the time of addition in the preparation of Em-2, etc.

Preparation of emulsion Em-10 through Em-24

Em-10 through Em-24 were prepared in the same manner as Em-3 except that the amount of potassium bromide and potassium iodide in Solution A3, period of addition of Solution B3 and Solution C3, temperature during the time of Addition in the preparation of Seed Emulsion-2, and an amount of Seed Emulsion-2 in Solution A5, amount of potassium bromide and potassium iodide in Solution B5, pAg at the time of addition, additioning speed, period of addition, temperature at the time of addition in the preparation of emulsion Em-3 were varied.

Grain shape, iodide content, grain structure, the average grain size, the average aspect ratio (AR), the average values of (t/1), and proportion of (100) face in the side-face portion of the grains of silver halide emulsions Em-1 through Em-24 are shown in Table 1.

TABLE 1

| Em No | Grain shape | Iodide content (%) | Grain structure | Diameter (μm) | AR | t/l | (100) % | Remarks |
|---|---|---|---|---|---|---|---|---|
| Em-1 | Telradeca-hedral | 2.0 | Uniform | 0.550 | 1.0 | 1.0 | 20 | Comp. |
| Em-2 | Tabular | 2.0 | Uniform | 0.981 | 4.5 | 11. | 22 | Inv. |
| Em-3 | Tabular | 2.0 | core/shell | 0.961 | 4.5 | 10. | 14 | Inv. |
| Em-4 | Tabular | 2.0 | Uniform | 0.981 | 4.5 | 11. | 0 | Comp. |
| Em-5 | Tabular | 2.0 | Uniform | 0.981 | 4.5 | 4.8 | 22 | Comp. |
| Em-6 | Tabular | 2.0 | Uniform | 0.981 | 4.5 | 4.8 | 0 | Comp. |
| Em-7 | Tabular | 2.0 | Uniform | 1.163 | 7.5 | 5.7 | 0 | Comp. |
| Em-8 | Tabular | 2.0 | Uniform | 1.163 | 7.5 | 3.6 | 15 | Comp. |
| Em-9 | Tabular | 2.0 | Uniform | 1.163 | 7.5 | 11. | 17 | Inv. |
| Em-10 | Tabular | 2.0 | core/shell | 0.961 | 4.5 | 4.9 | 18 | Comp. |
| Em-11 | Tabular | 2.0 | core/shell | 0.961 | 4.5 | 9.7 | 0 | Comp. |
| Em-12 | Tabular | 2.0 | core/shell | 0.961 | 4.5 | 4.8 | 0 | Comp. |
| Em-13 | Tabular | 1.0 | core/shell | 1.113 | 7.7 | 12. | 28 | Inv. |
| Em-14 | Tabular | 1.0 | core/shell | 1.113 | 7.7 | 4.2 | 28 | Comp. |
| Em-15 | Tabular | 1.0 | core/shell | 1.113 | 7.7 | 12. | 0 | Comp. |
| Em-16 | Tabular | 1.0 | core/shell | 1.113 | 7.7 | 4.2 | 0 | Comp. |
| Em-17 | Tabular | 5.1 | core/shell | 1.866 | 7.0 | 10. | 30 | Inv. |
| Em-18 | Tabular | 5.1 | core/shell | 1.866 | 7.0 | 4.8 | 30 | Comp. |
| Em-19 | Tabular | 5.1 | core/shell | 1.866 | 7.0 | 10. | 0 | Comp. |
| Em-20 | Tabular | 5.1 | core/shell | 1.866 | 7.0 | 4.8 | 0 | Comp. |
| Em-21 | Tabular | 0.5 | core/shell | 0.774 | 4.0 | 8.4 | 25 | Inv. |
| Em-22 | Tabular | 0.5 | core/shell | 0.774 | 4.0 | 4.3 | 25 | Comp. |
| Em-23 | Tabular | 0.5 | core/shell | 0.774 | 4.0 | 8.4 | 0 | Comp. |
| Em-24 | Tabular | 0.5 | core/shell | 0.774 | 4.0 | 4.3 | 0 | Comp. |

Subsequently, these emulsions each were spectrally sensitized by adding optimum amount of optical sensitizing dye (I) in the form of methanol solution and were subjected to optimum gold-sulfur sensitization by using ammonium thiocyanate, auric chloride and, sodium thiosulfate. Then 4-hydroxy- 6-methyl-1,3,3a, 7-tetrazaindene (1 g/mol Ag) was added.

Sensitizing dye (I)

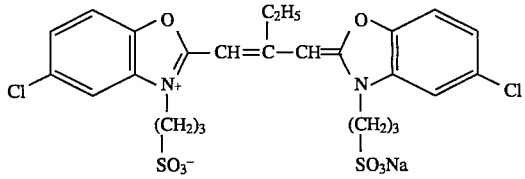

To the thus obtained silver halide emulsions, additives given hereinbelow were added to prepare emulsion coating solutions. Moreover, at the same time, coating solution for a protective layer having a composition given as below was prepared. By the use of a simultaneous double-sided slide-hopper type coating machine respective emulsions were simultaneously coated on both sides of a 175 μm-thick polyethylene terephthalate film support at a speed of 80 m a minute so that the amount of silver and gelatin coated on each side are 2.0 g/m$^2$ and 3.1 g/m$^2$, respectively, and dried for a period of 2 minutes 20 seconds, to prepare Samples No. 1 through No. 24. The film substrate used was a polyethylene terephthalate film substrate for X-ray photography having 175 μm thickness subbed with an aqueous dispersion containing a copolymer comprising three kinds of monomers consisting of 50 wt % of glycidylmethacrylate, 10 wt % of methylacrylate and 40 wt % of butylmethacrylate, and dyed in blue at density of 0.15.

Additives used for the emulsion are as follows. Addition amount is given in terms of weight per mol of silver halide:

| | |
|---|---|
| 1,1-dimethylol-1-bromo-1-nitromethane | 70 mg |
| t-butylcatechol | 400 mg |
| Polyvinyl pyrrolidone (molecular weight: 10,000) | 1.0 g |
| Styrene maleic anhydride copolymer | 2.5 g |
| Nitrophenyl-triphenylphosphonium chloride | 50 mg |
| Ammonium 1,3-dihydroxybenzene-4-sulfonate | 2 g |
| 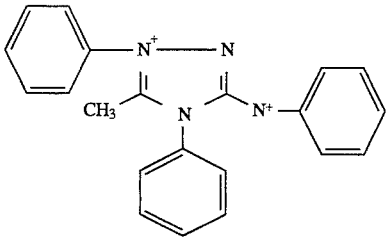 | 150 mg |
| 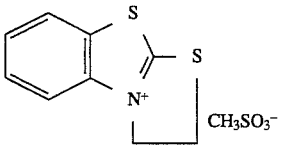 | 70 mg |
| $C_4H_9OCH_2CH(OH)CH_2N(CH_2COOH)_2$ | 1 g |
| 1-phenyl-5-mercaptotetrazole | 15 mg |

Composition of Protective Layer

Next, the following were prepared as a coating solution for a protective layer. An amount of Addition is given in terms of weight per liter of coating solution:

| | |
|---|---|
| Lime processed inert gelatin | 68 g |
| Acid-processed gelatin | 2 g |
| Sodium-iso-amyl-n-decylsulfosuccinate | 1 g |
| Polymethylmethacrylate (matting agent, area average grain size of 3.5 microns) | 1.1 g |
| Silicon dioxide grain (matting agent, area average grain size of 1.2 microns) | 0.5 g |
| $(CH_2{=}CHSO_2CH_2)_2O$ (hardener) | 500 mg |
| $C_4F_9SO_3K$ | 2 mg |
| $C_{12}H_{25}CONH(CH_2CH_2O)_5H$ | 2.0 g |
| 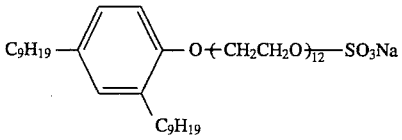 | 1.0 g |
| 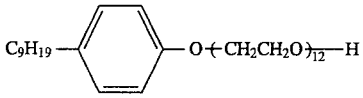 | 0.4 g |

-continued

| | |
|---|---|
| 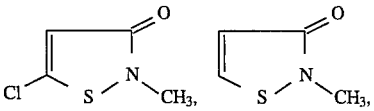 (Component A) (Component B) | 0.1 g |
| 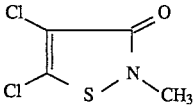 (Component C) | |
| Component A:Component B:Component C = 50:46:4 (mol ratio) | |

Samples No. 1 through No. 24 were evaluated with respect to photographic characteristics thereof as follows.

First of all, each sample was placed between two intensifying screens (KO-250),and was exposed to x-ray through an aluminium wedge for 0.05 seconds with tube voltage of 80 kvp and tube current of 100 mA. The exposed sample was processed in a automatic processor (SRX-502, a product of Konica Corporation), wherein compositions of developing solution and fixing solution are as follows:

| Composition of Developing solution | |
|---|---|
| Part-A (for 12 l finish) | |
| Potassium hydroxide | 450 g |
| Potassium sulfite (50% solution) | 2280 g |
| Diethylenetetraamine pentaacetic acid | 120 g |
| Sodium bicarboniate | 132 g |
| 5-methylbenztriazole | 1.2 g |
| 1-phenyl-5-mercaptotetrazole | 0.2 g |
| Hydroquinone | 340 g |
| Add water to make the total volume. | 5000 ml. |
| Part-B (for 12 l finish) | |
| Glacial acetic acid | 170 g |
| Triethyleneglycol | 185 g |
| 1-phenyl-3-pyrazolidone | 22 g |
| 5-nitroindazole | 0.4 g |
| Starter | |
| Glacial acetic acid | 120 g |
| Potassium bromide | 225 g |
| Add water to make the total volume | 1.0 l |
| **Composition for Fixing Solution** | |
| Part-A (for 18 l finish) | |
| Ammonium thiosulfate (70 wt/vol %): | 6000 g |
| Sodium sulfite | 110 g |
| Sodium acetate trihydride | 450 g |
| Sodium citrate | 50 g |
| Gluconic acid | 70 g |
| 1-(N,N-dimethylamino)-ethyl-5-mercaptotetrazoled | 18 g |
| Part-B | |
| Aluminium sulfate | 800 g |

The developing solution was prepared by simultaneously adding Part A and Part B to about 5 l of water.

Then while stirring and dissolving the chemicals, water was added to make the total volume 12 l and adjust pH at 10.40 with glacial acetic acid. This solution was made developer replenisher.

20 ml/l of the above-mentioned starter was added, to 1 liter of this developer replenisher and pH was adjusted at 10.26 to make a working solution.

The fixing solution was prepared by adding Part A and Part B simultaneously to about 5 l of water and while dissolving chemicals, water was added to make the total volume 18 l, and adjusted pH at 4.4 using sulfuric acid and NaOH. This solution was made a fixer replenisher.

Processing temperature was 35° C. for development, 33° C. for fixing, 20° C. for washing, and 50° C. for drying and the total dry-to dry processing time was 45 seconds.

After processing, sensitiometry was carried out with respect to the processed Samples. Sensitivity is given by reciprocal of the exposure amount necessary to give fog density +0.5 and shown in relative sensitivity value when the sensitivity of Sample No. 1 was referred to as 100. The results are shown in Table 2 as below.

From the table, it is understood that the Samples of the present invention exhibit relatively higher sensitivity when compared among emulsions having the same silver iodide content, grain size, and aspect ratio.

Next, each sample was aged for seven days under following conditions.

Condition A: 23° C., 55%RH

Condition B: 40° C., 80%RH

After aging, the samples were processed in the same manner as mentioned hereinabove, and thereafter the same sensitometry was carried out to evaluate sensitivity fluctuation caused by aging.

Sensitivity differences as to respective samples when they were preserved under Condition A and Condition B were obtained. Sensitivity difference is expressed in a value relative to the sensitivity difference of Sample No. 1 which is set at 100. Thus the smaller the value is, less is the fluctuation. Results are shown in Table 2.

It is understood from Table 2 that the samples of the present invention is less in the sensitivity fluctuation and excellent in aging stability, comparative samples when they were preserved under the high humidity, as compared to comparative samples comprising an emulsion having almost the same iodide content, grain size and aspect ratio.

Furthermore, after applying load of 5 grams onto the respective Samples No. 1 through No. 24 before light exposure using a scratch hardness tester equipped with a needle of 0.3 mm, the same processing as above was carried out and fog density caused by pressure was measured using a microdensitometer, thus to investigate degree of occurrence of pressure fogging.

The level of the fog densities of the respective samples are shown in relative values to the density increase of Sample No. 1 which is set at 100. The results are shown in Table 2.

A samples containing tabular grains of which (t/l) is not less than 5 and proportion of (100) face is not less than 10%, as compared with samples containing tabular grains of which (t/l) is less than 5 or samples containing tabular grains having the proportion of (100) face of not more than 10%, exhibits decreased pressure fog and is improved in pressure resistance as compared with a samples containing tetradecahedral grains.

Further, it is shown that this effect is small with respect to a sample containing tabular grains having (t/l) of not less than 5 and the proportion of (100) face of less than 10%, or tabular grains having (t/l) of less than 5 and the proportion of (100) face of more than 10%.

Accordingly, in order to accomplish the objects of the present invention, it is indispensable that both conditions that (t/l) is not less than 5 and that proportion of (111) face is not more than 90% are satisfied at the same time.

Still further, pressure characteristics occurred at the time of development (pressure marks caused by processor rollers) was evaluated as follows; thus, unexposed samples were processed for a period of 45 seconds using a x-ray processor provided therein opposing rollers having rough surfaces. In this process, the processing was carried out using the same processing solutions mentioned above. Then marks occurred on the samples were visually observed and classified into five grades defined below:

5: No roller mark was observed.

4: Only small number of roller marks were observed.

3: Roller marks within practical tolerance were observed.

2: Roller marks outside a practical tolerance were observed.

1: Large number of roller marks were observed.

The results are shown in Table 2.

TABLE 2

| Sample No. | Sensitivity | Aging stability | Pressure fogging | Roller marks | Remarks |
|---|---|---|---|---|---|
| 1 | 100 | 100 | 100 | 4 | Comp. |
| 2 | 159 | 30 | 83 | 5 | Inv. |
| 3 | 178 | 35 | 91 | 5 | Inv. |
| 4 | 149 | 39 | 137 | 3 | Comp. |
| 5 | 150 | 70 | 143 | 2 | Comp. |
| 6 | 140 | 87 | 153 | 2 | Comp. |
| 7 | 175 | 74 | 181 | 1 | Comp. |
| 8 | 176 | 100 | 184 | 1 | Comp. |
| 9 | 192 | 30 | 114 | 4 | Inv. |
| 10 | 171 | 70 | 146 | 2 | Comp. |
| 11 | 170 | 43 | 141 | 2 | Comp. |
| 12 | 162 | 87 | 154 | 2 | Comp. |
| 13 | 213 | 26 | 112 | 4 | Inv. |
| 14 | 198 | 74 | 178 | 1 | Comp. |
| 15 | 202 | 35 | 171 | 1 | Comp. |
| 16 | 187 | 100 | 191 | 1 | Comp. |
| 17 | 594 | 26 | 89 | 5 | Inv. |
| 18 | 561 | 61 | 148 | 2 | Comp. |
| 19 | 557 | 39 | 147 | 2 | Comp. |
| 20 | 526 | 87 | 162 | 1 | Comp. |
| 21 | 121 | 39 | 92 | 5 | Inv. |
| 22 | 116 | 74 | 144 | 2 | Comp. |
| 23 | 112 | 52 | 142 | 2 | Comp. |
| 24 | 107 | 100 | 155 | 2 | Comp. |

From Table 2, it is understood that the samples according to of the present invention cause no problem with regard to occurrence of roller marks during processing thereof.

What is claimed is:

1. A silver halide photographic light-sensitive material comprising a support having provided thereon a silver halide emulsion layer comprising silver halide grains, at least 70% of a total projected area of said silver halide grains comprising silver halide tabular grains having an aspect ratio of less than 8, and having at least two twin planes, an average ratio (t/l) of thickness (t) to a longest distance selected from the distances between adjacent twin planes (l) of said tabular grains being not less than 7, said tabular grains having two principal plane faces comprising (111) faces, and side faces comprising (111) and (100) faces, a maximum of 90% of said side faces being (111) faces.

2. The silver halide photographic material of claim 1, wherein said tabular grains have a diameter of 0.4 to 3.0 μm and a thickness of 0.05 to 1.0 μm.

3. The silver halide photographic material of claim 1, wherein said tabular grains having the ratio (t/l) of 5 or more account for at least 50% of total number of grains contained in said emulsion.

4. The silver halide photographic material of claim 1, wherein said principal plane face has a hexagonal shape having a ratio of the longest edge length to the shortest edge length forming the hexagonal shape of 1.0 to 2.0.

5. The silver halide photographic material of claim 1, wherein said tabular grains comprise silver bromide, silver iodobromide or silver chloroiodobromide.

6. The silver halide photographic material of claim 5, wherein said tabular grains are silver iodobromide grains comprising core and shell different in iodide contents from one another.

7. A silver halide photographic material of claim 1 wherein said tabular grains have a flatness of 20 or more, expressed in terms of $d/(t)^2$, in which d represents a diameter of said tabular grain, and t represents a thickness thereof.

8. The silver halide photographic material of claim 7, wherein said flatness is within a range of not less than 20 and less than 80.

* * * * *